US005709138A

United States Patent [19]

Rimer

[11] Patent Number: 5,709,138

[45] Date of Patent: Jan. 20, 1998

[54] METHOD AND APPARATUS FOR PRECISION CUTTING OF FIBERS

[75] Inventor: Paul D. Rimer, Orlando, Fla.

[73] Assignee: Martin Marietta Corporation, Bethesda, Md.

[21] Appl. No.: 698,279

[22] Filed: Aug. 15, 1996

Related U.S. Application Data

[63] Continuation of Ser. No. 176,259, Jan. 3, 1994, abandoned.

[51] Int. Cl.[6] ..... B26D 1/11

[52] U.S. Cl. ..... 83/18; 83/175; 83/454; 83/620; 83/909

[58] Field of Search ..... 83/687, 681, 913, 83/18, 175, 620, 454, 452, 599, 637, 821, 697, 613, 909, 950; 30/115; 269/87.2, 292, 295; 19/0.6; 28/282, 226

[56] References Cited

U.S. PATENT DOCUMENTS

| | | | |
|---|---|---|---|
| D. 136,046 | 7/1943 | Downer | 30/115 |
| 1,448,938 | 3/1923 | Parott | 30/115 |
| 2,720,901 | 10/1955 | Heller | 83/620 |
| 3,308,520 | 3/1967 | Gagnon | 83/913 |
| 4,050,975 | 9/1977 | Draffone | 269/295 |
| 4,134,120 | 1/1979 | DeLoach et al. . | |
| 4,145,471 | 3/1979 | Kendall et al. . | |
| 4,202,856 | 5/1980 | Frikken et al. . | |
| 4,228,709 | 10/1980 | Guzay, Jr. et al. | 83/622 |
| 4,382,590 | 5/1983 | Pandya et al. | 269/87.2 |
| 4,464,963 | 8/1984 | Paul | 83/613 |
| 4,606,848 | 8/1986 | Bond . | |
| 4,722,860 | 2/1988 | Doljack et al. . | |
| 4,783,279 | 11/1988 | Petermann et al. . | |
| 4,812,854 | 3/1989 | Boan et al. . | |
| 4,825,049 | 4/1989 | Rickborn . | |
| 4,868,580 | 9/1989 | Wade . | |
| 4,881,998 | 11/1989 | Youngkeit . | |
| 4,898,056 | 2/1990 | Grobb et al. | 83/691 |
| 4,924,228 | 5/1990 | Novak et al. . | |
| 4,926,910 | 5/1990 | Wade . | |
| 4,941,380 | 7/1990 | Lockwood | 83/454 |
| 5,032,016 | 7/1991 | Youngkeit . | |
| 5,089,326 | 2/1992 | Bonazza . | |
| 5,294,282 | 3/1994 | Rock et al. | 83/452 |

*Primary Examiner*—Maurina T. Rachuba
*Attorney, Agent, or Firm*—Burns, Doane, Swecker & Mathis, LLP

[57] ABSTRACT

An apparatus for precision cutting of fiber tow is provided which includes a structure for securing a taut length of fiber tow between two points, a movable cutter, and a structure for guiding a cutting edge of the cutter substantially perpendicularly against the taut length of fiber tow at a predetermined point between the two points. A method of using the apparatus is also disclosed.

10 Claims, 4 Drawing Sheets

METHOD AND APPARATUS FOR PRECISION CUTTING OF FIBERS

This application is a continuation of application Ser. No. 08/176,259, filed Jan. 3, 1994, now abandoned.

BACKGROUND

This invention relates to apparatuses and methods for precision cutting of fibers and, more particularly, to the precision cutting of graphite fiber tow.

The use of graphite fiber tows or yarns, hereinafter referred to generically as tow, is well known. Such tows are usually made up of 3000 to 12,000 fibers, each fiber being approximately seven micrometers in diameter. Applications for such fibers arise, for example, in the construction of radiofrequency enclosures in which fiber strands are knitted into desired shapes, as described in U.S. Pat. Nos. 4,722,860, 4,812,854, 4,825,049, 4,868,580, and U.S. Pat. No. 4,926,910. Another application for individual fibers or tows of fibers is in electroconductive molding compositions in which conductive graphite fibers are mixed with resins or other materials to form a composite material, such as is described in U.S. Pat. Nos. 4,134,120, 4,145,471, 4,202,856, 4,783,279, 4,881,998, 5,032,016, and U.S. Pat. No. 5,089,326. Yet a further application for fibers or tows include their use in radar attenuating materials such as paint into which the fibers are mixed, as described in U.S. Pat. No. 4,606,848 and U.S. Pat. No. 4,924,228. Energy emitted at various wavelengths or frequencies is prevented from causing interference in areas that are shielded by matrices including fibers having lengths corresponding to the emitted wavelengths. As discussed by U.S. Pat. No. 4,606,848 to Bond, it is possible to create a composition that is adapted to absorb a range of frequencies by mixing together different lengths of fibers.

While graphite fibers are known to have excellent characteristics for the above-mentioned purposes and to have high tensile strengths, they are also known to be quite brittle and susceptible to breaking. Thus, handling of graphite fibers has required a certain amount of ingenuity. Processes directed toward handling of such fibers have generally required several fairly involved steps. For example, U.S. Pat. No. 4,812,854 to Boan et al. discloses a process for individually coating small diameter graphite filaments with a stress-absorbing layer, such as a thin metallic or organic coating, and assembling the filaments into a fiber tow. The tow may then be knitted into a desired structure and, if desired, the stress-absorbing layer can be removed by being either heated or chemically dissolved.

It is very difficult to cut graphite fibers against an anvil without crushing the ends and tearing the fiber. One technique for cutting tows such that the cuts have square edges and fairly uniform fiber lengths is to preimpregnate the fibers with a resin or desired material, such as is described by U.S. Pat. No. 4,145,471 to Kendall et al., prior to further working. This procedure minimizes fraying of the tow and cracking of individual fibers. The cut preimpregnated fiber lengths may then, for instance, be molded into a desired shape, mixed directly into a desired matrix, or be further processed to remove the material with which they have been preimpregnated. The fibers cut in this fashion, however, are still not necessarily always of the precisely desired length because individual fiber lengths may differ over a relatively short length of impregnated fiber tow.

SUMMARY

In accordance with one aspect of the present invention, an apparatus for precision cutting of a fiber tow comprises a structure for securing a taut length of fiber tow between two points. The apparatus has a movable cutter having two opposing sides separated by a predetermined distance and at least one cutting edge. The at least one cutting edge of the cutter is guided by a structure for guiding the cutter and is movable substantially perpendicularly against the taut length of fiber tow at a predetermined point between the two points to cause a shear cut.

In a further aspect, the apparatus is adapted to hold a cut length of fiber tow in position relative to a cutter after the length of tow has been cut.

In a further aspect, the cutter comprises a razor blade.

In a further aspect, the cutting edge of the cutter is guided perpendicularly in an elongated slot in a pair of plates, against a length of fiber tow that is secured between the plates.

In a further aspect, the cutter comprises two cutters, each cutter having a cutting edge that is guided perpendicularly in one of two elongated slots in a pair of plates, against a length of fiber tow that is secured between the plates, the slots being disposed in the pair of plates at a predetermined distance from one another.

In a further aspect, the cutter comprises an endless belt.

A method according to another aspect of the present invention comprises the steps of securing a length of fiber tow in a taut condition in a position between two points, holding the fiber tow in the position, and guiding a cutter perpendicularly against the fiber tow to cause a shear cut at a predetermined distance relative to the two points.

BRIEF DESCRIPTION OF THE DRAWINGS

The features and advantages of the present invention will be well understood by reading the following detailed description in conjunction with the drawings in which like numerals indicate similar elements and in which.

DETAILED DESCRIPTION

Figure 1:
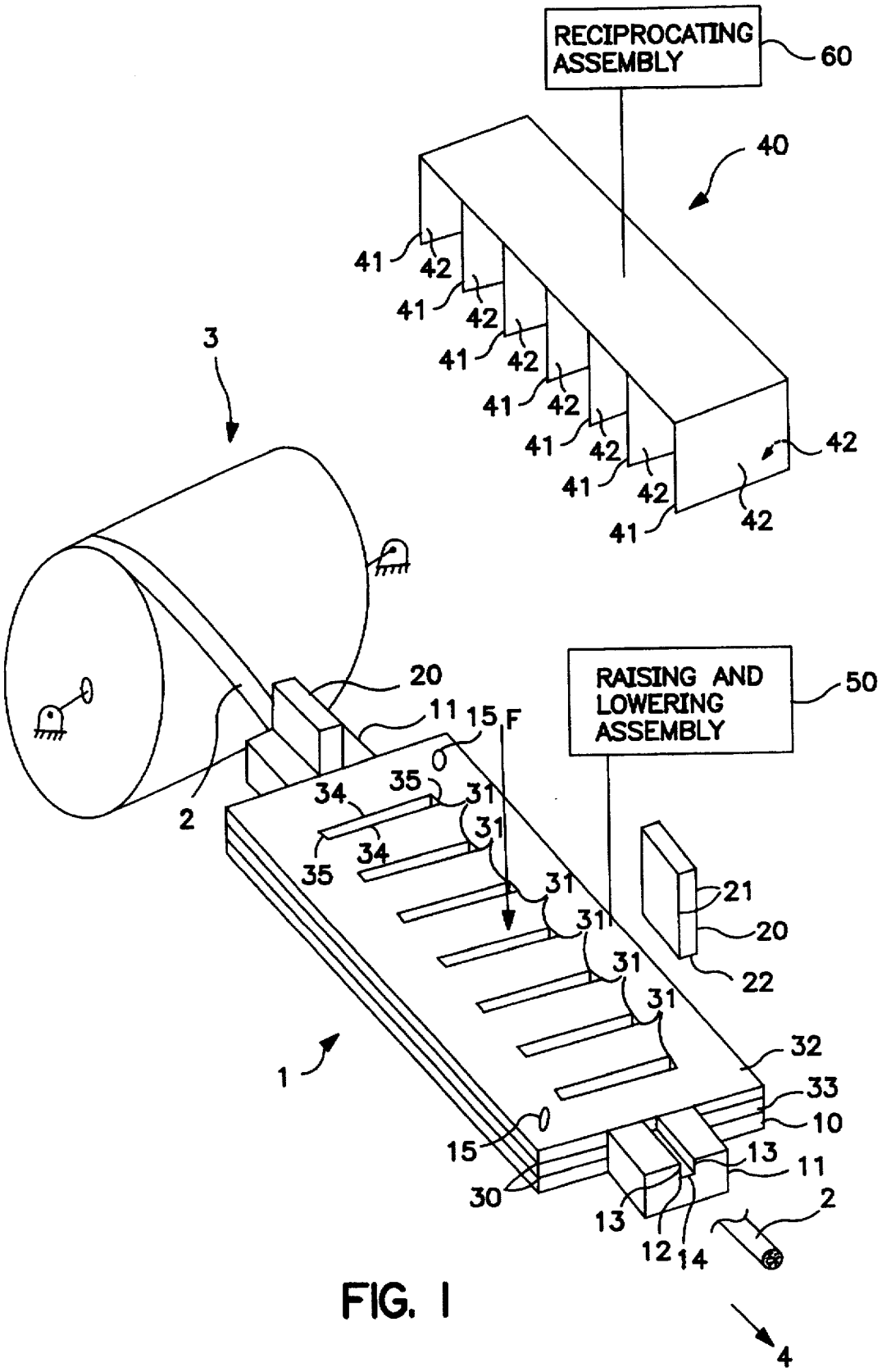
FIG. 1 is a perspective view of an apparatus for precision cutting of fibers according to an embodiment of the present invention.

With reference to FIG. 1, in an apparatus 1 for the precision cutting of a fiber tow according to an embodiment of the present invention, a fiber tow 2 such as a graphite fiber tow is fed from a spool 3 to the apparatus 1. The tow 2 may be unwound from the spool 3 for cutting by the apparatus 1 either manually or, by supplying a motor (not shown), automatically.

Figure 4:
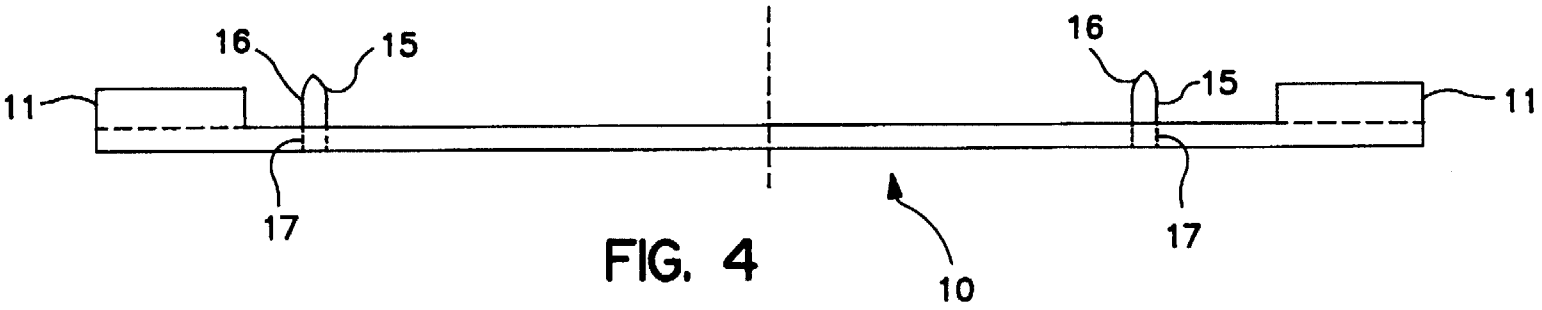
FIG. 4 is a frontal view of the base plate illustrated in FIGS. 2 and 3.
Figure 2:
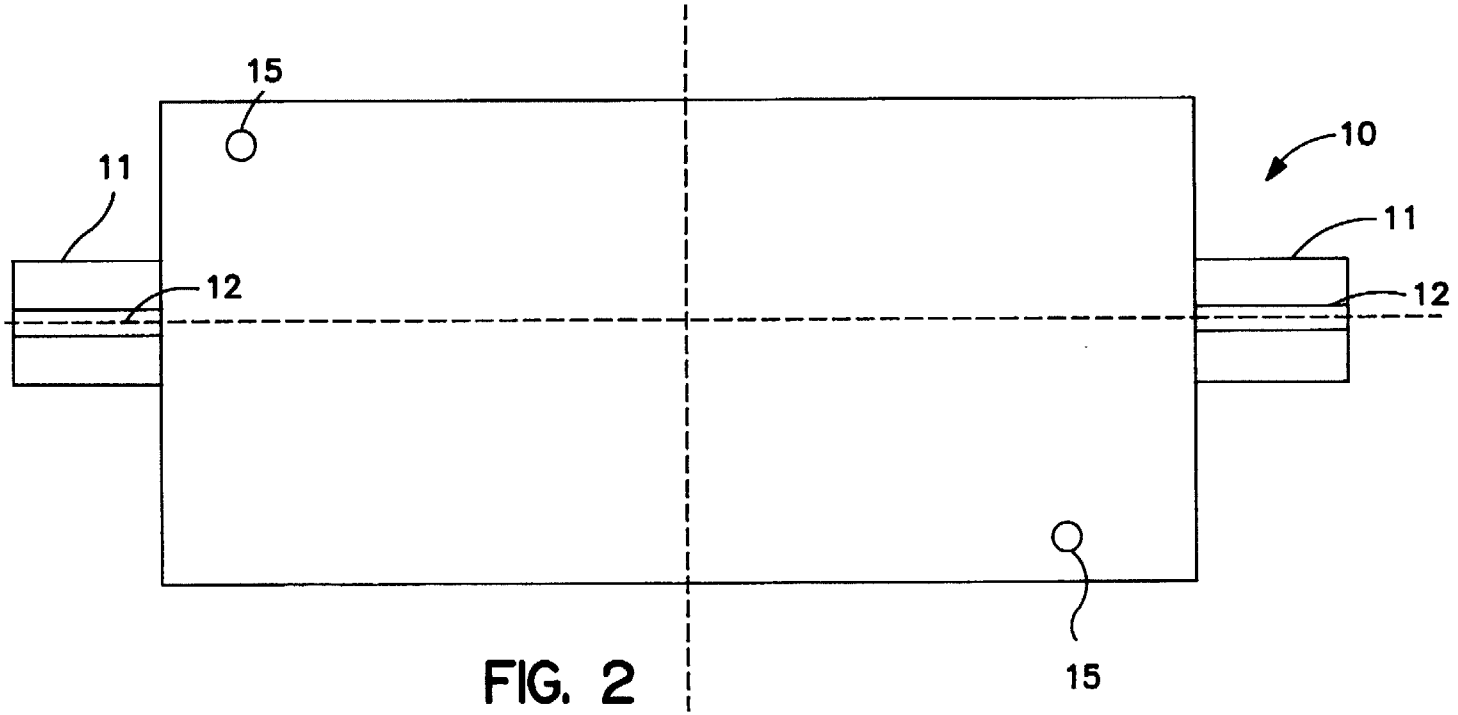
FIG. 2 is top view of a base plate according to an embodiment of the present invention.
Figure 3:
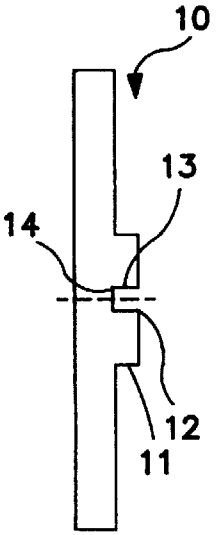
FIG. 3 is a side view of the base plate illustrated in FIG. 2.

The apparatus 1 includes a base plate 10, which is shown in top, side, and front views in FIGS. 2, 3, and 4, respectively. A length of fiber tow 2 is secured in position relative to the base plate 10 in a pair of end blocks 11, 11, disposed at opposite ends of the base plate 10. The fiber tow 2 is pulled taut, without breaking the fiber tow, between the end blocks 11, 11 and secured in an end block channel 12 in each end block 11. As seen most clearly in FIG. 3, the end block channel 12 is formed by a pair of opposed end block sidewalls 13 and an end block bottom 14. The end block channel 12 may be specifically sized to just fit a particular diameter of fiber tow 2; however, the end block channel may also be significantly larger without seriously impacting the performance of the apparatus 1. As explained further below, a primary purpose of the base plate 10 is to provide a frame around which other elements of the apparatus 1 are arranged in relation to one another. Clearly, other means for arranging the elements of the apparatus 1 in relation to one another are available and are discussed further below.

As shown in FIG. 1, the fiber tow 2 is secured in place in the end block channels 12, 12 by a pair of end block wedges 20, 20 which are forced into the end block channels 12, 12. The end block wedges 20 are formed with two opposed end wedge side walls 21, 21 and an end wedge bottom 22. The end wedge side walls 21, 21 may be formed such that they deviate from being parallel by a small angle. Thus, as a wedge 20 is forced into an end block channel 12, the end wedge side walls 21, 21 are caused to frictionally engage the side walls 13, 13 of the end block channel 12.

Figure 6:
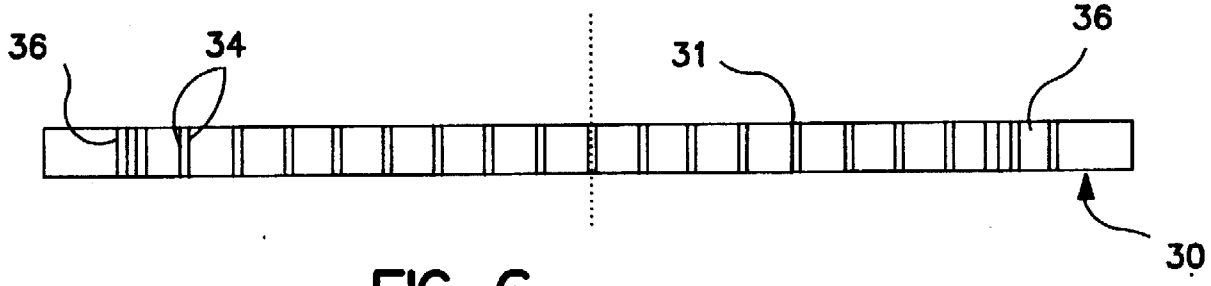
FIG. 6 is a cross-sectional view of the guide plate illustrated in FIG. 5.
Figure 5:
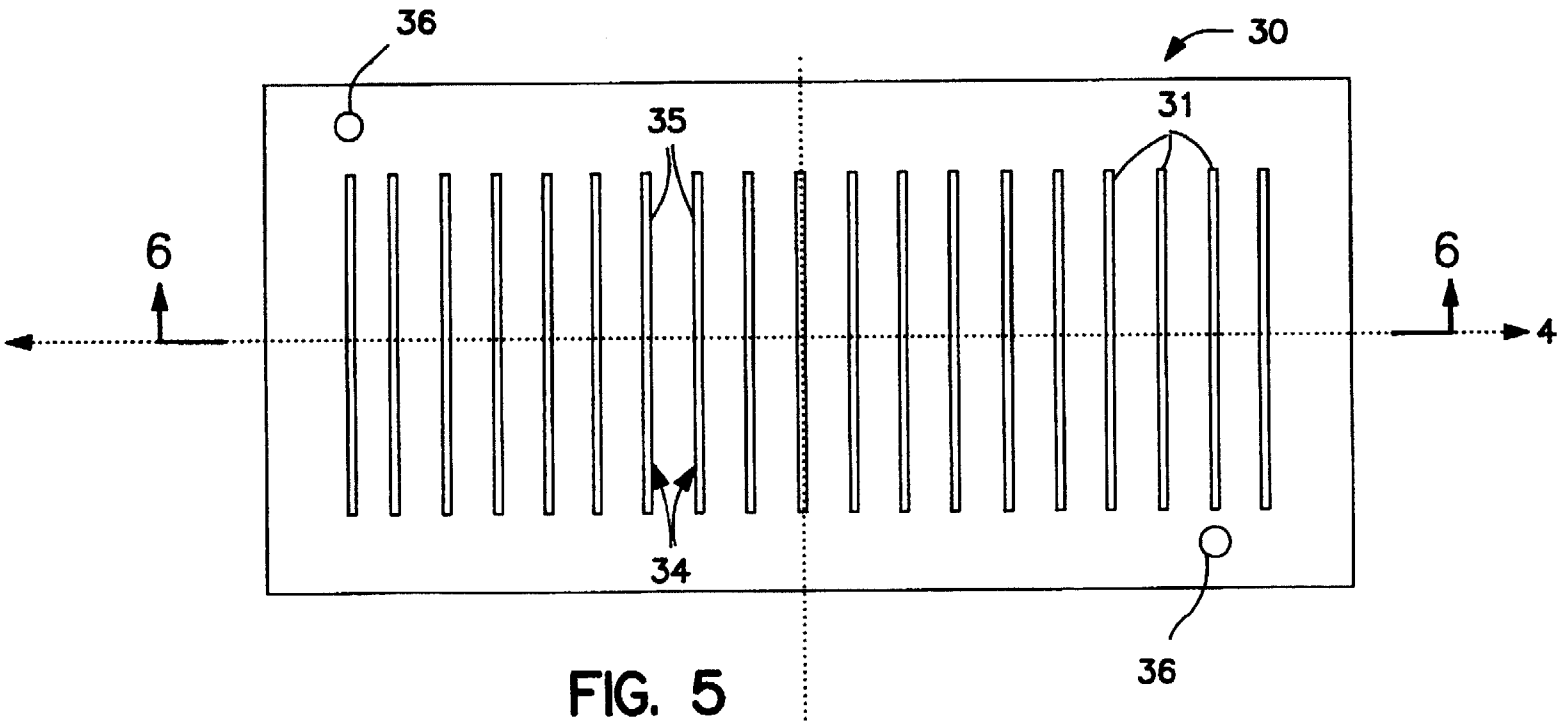
FIG. 5 is a top view of a guide plate according to an embodiment of the present invention.

A pair of guide plates 30, 30 having one or more guide slots 31 are positioned relative to the base plate 10. Of the guide plates 30, 30, one guide plate 32 is farther from the base 10 and one guide plate 33 is closer to the base 10. Normally, the guide plates 32, 33 are identical to one another and each have a plurality of slots 31 that are aligned, when the guide plates 32, 33 are in position, and form a pair of opposed slot side walls 34, 34 and a pair of opposed slot end walls 35, 35. As shown by the guide plate 30 illustrated in FIGS. 5 and 6, the guide slots 31 are arranged to be perpendicular to the longitudinal direction 4 of the fiber tow 2 when two guide plates 30, 30 are in position. Normally, the guide plates 30, 30 will include multiple guide slots 31, discussed further below, separated by a predetermined distance from one another, the predetermined distance corresponding to the desired fiber length.

The guide plates 32, 33 are normally aligned relative to the base plate 10, and to each other, by one or more pins 15 disposed through a like number of alignment holes 36 in each guide plate 32, 33. The pins 15 may be connected to the base plate 10 by any conventional means, such as by welding the pins 15 to the base plate 10, by a compression fit between the pins 15 and a pin hole 17 in the base plate, or by threading the pin 15 and the pin hole 17 and screwing the pin into the pin hole. The pin 15 is normally supplied with a pin tip 16 having a tapered shaped to facilitate raising and lowering of guide plates 32, 33 relative to the base plate 10.

Of course, the guide plate 33 that is closer to the base plate 10 does not have to be movable relative to the base plate 10, and may be formed integrally with the base plate 10. However, the guide plate 32 that is farther from the base plate 10 should be able to be raised and lowered, e.g., by an assembly 50 for raising and lowering the plate at least relative to the other guide plate 33, to permit the fiber tow 2 to be held between the guide plates 32, 33. Furthermore, the guide plates 32, 33 may be aligned relative to one another by means other than by a pin 15 and base plate 10 assembly. Alternative means for aligning the guide plate 32 relative to the guide plate 33 may, for example, comprise a guide plate 32 or 33 formed with a recess (not shown) for receiving a guide plate 33 or 32, respectively, and in which the guide plate 33 or 32 is in an aligned position.

The end blocks 11 need not be physically attached to a base plate 10 as shown. The apparatus 1 may, instead, comprise end blocks 11 that are independently positioned at predetermined positions such as those shown in FIG. 1, or, in the alternative, at any desired position relative to the guide plates 32, 33 for securing fiber tow relative to the guide plates 32, 33. The primary purpose of the end blocks 11, 11 is to secure the fiber tow 2, relative to the plates 32, 33, in a straight fashion to ensure that the cutting operation, described below, will produce uniform, desired-length cuts.

When a length of fiber tow 2 is secured between the end blocks 11, 11 and positioned between the guide plates 30, 30, the fiber tow is held in position relative to the guide plates 30, 30 by application, to the guide plates, of a force F. The force F is sufficient to hold the fiber tow in position during and after the cutting operation described below, independent of the securing effect provided by the end blocks 11, 11 and the end wedges 20, 20, without damaging the fiber tow. The force may simply be the result of the weight of the guide plate 32. Alternatively, an outside force F as shown in FIG. 1, such as a force applied by a human's hand, a clamp, a piston, or a hydraulic mechanism (not shown), may be applied to the guide plate 33, particularly when the planar faces of the guide plates 30, 30 are oriented vertically.

Fiber tow 2 is cut, when a length of fiber tow is held in position between the guide plates 30, 30 and secured in position between two end blocks 11, by a cutter assembly 40 that is movable longitudinally in a guide slot 31. The cutter assembly 40 has a cutting edge 41 that is perpendicular to two opposing sides 42. The cutter assembly 40 may consist of nothing more than a hand-held razor blade that fits snugly within the slot 31 to ensure that the cutting edge 41 will be forced perpendicularly against the fiber tow 2. In operation, the opposing sidewalls 42, 42 of the cutter assembly abut the side walls 34, 34 of the guide slot 31 to ensure perpendicular alignment of the cutting edge 41 relative to the tow 2.

Figure 7A:
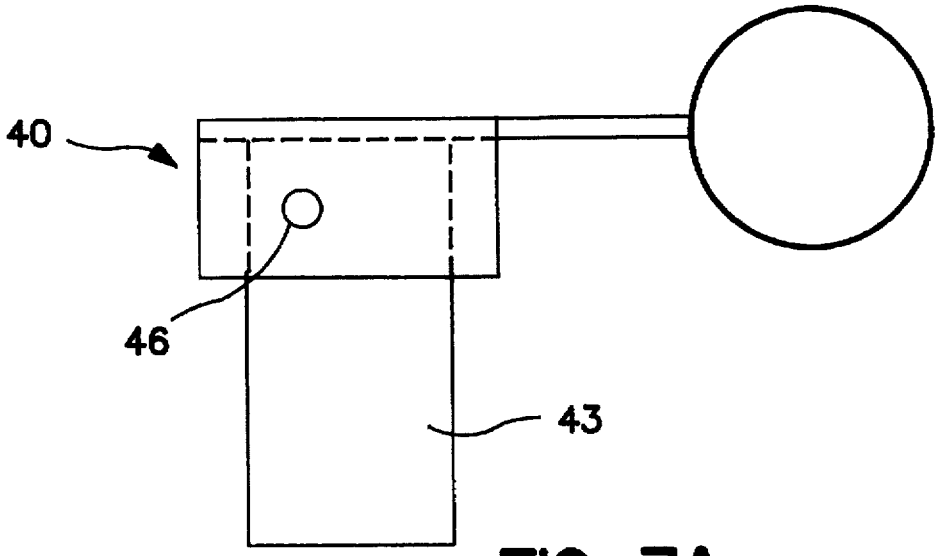
FIG. 7A is a side view of a cutter assembly according to an embodiment of the invention.
Figure 7B:
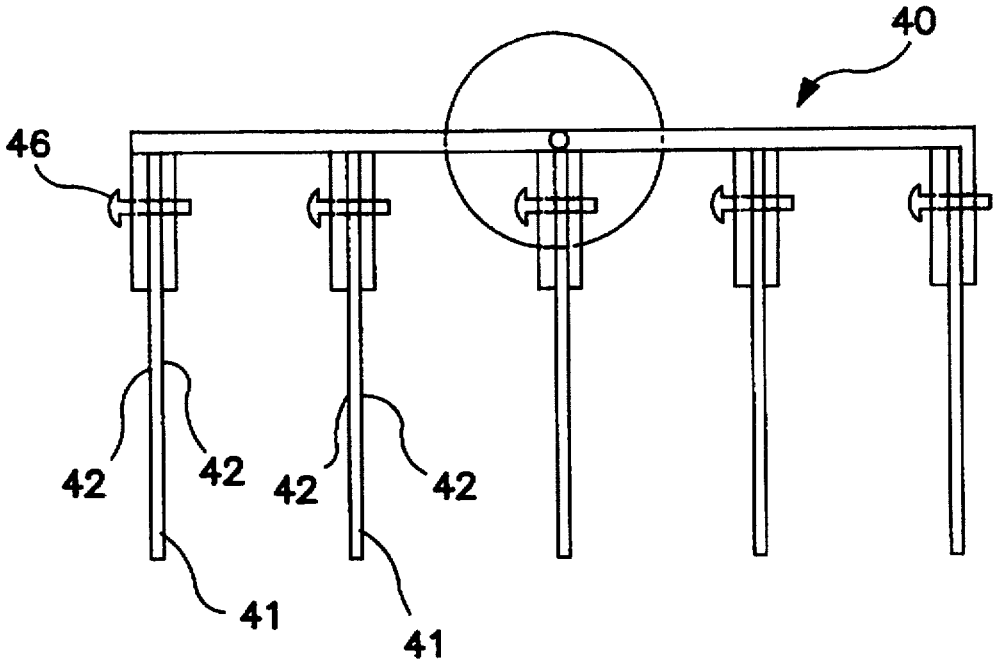
FIG. 7B is a view at 90° to the view of FIG. 7A.

The cutter assembly 40 may also include a plurality of detachable blades 43, as shown in FIGS. 1, 7A and 7B, for a corresponding plurality of guide slots 31, or band- or scroll-saw apparatuses and a means (not shown) for moving the cutting edge 41 of the particular structure perpendicularly against the fiber tow 2. The means for moving the cutting edge 41 may, again, comprise manual means, such as a human hand, or automatic means, such as a reciprocating arm 60 that is powered hydraulically or electrically.

Because fiber tow 2 such as graphite fiber tow has a tendency to quickly wear cutting implements, it is desirable to be able to easily replace the blade 43 or the cutting edge 41. This may be achieved by any number of well known means such as by, for example, individually securing detachable blades 43 to the cutter assembly 40 by a series of set screws (not shown), clamps (not shown), or pins 46.

Multiple blades 43 on a cutter assembly 40 may be operated simultaneously to make multiple shear cuts through the fiber tow 2 in a single motion. Further, multiple lengths of fiber tow 2 may be fed from multiple spools 2, secured between multiple end blocks or similar structures, held between a single pair of guide plates 30, 30, and cut by multiple cutters 40, or by a single cutter 40 having multiple blades 43. The cutting operation may be performed by a cutter 40 moving vertically or horizontally relative to, for example, horizontally disposed plates 32, 33.

Guide plates 30, 30 consisting of ⅛ inch mild steel, having guide slots 31 approximately 0.010 inches in width for receiving a conventional, commercially-available razor blade, coupled with a base plate 10 of 0.20 inch mild steel, formed with end blocks 11, 11 having end block channels 12, 12 approximately 3/16 inches in width, have provided excellent results. Particularly, fiber lengths between 0.5 to 1.5 centimeters have been cut within a tolerance of +/−0.013 centimeters at a 95% confidence level. Individual fibers are not damaged in the cutting operation and the fiber ends are square and uniform.

The apparatus for precision cutting of fibers can be used and the method for precision cutting of fibers can be performed entirely manually by unskilled or semi-skilled labor. One skilled in the art will further appreciate that elements of the apparatus 1 and steps in the method of its use are easily combined with means for performing repetitive tasks such as raising and lowering of the plate 32 relative to plate 33, or raising and lowering of the wedge blocks 20, 20 relative to the end blocks 11, 11. For instance, the plate 32 and the wedge blocks 20, 20 may be connected, together or individually, to means such as a Dake® press, available from JSJ Corporation, Grand Haven, Mich., (not shown) a hydraulic press, air cylinders, or cam driven pressing devices that an operator can activate, after tow 2 is cut, to raise the plate 32 and wedge blocks 20, 20 and, after tow is fed to end block channels 12, 12, to lower the plate and wedge blocks.

It is, of course, possible to embody the invention in specific forms other than those described above without departing from the spirit of the present invention. The embodiments described above are merely illustrative and should not be considered restrictive in any way. The scope of the invention is given in the appended claims, rather than the preceding description, and all variations and equivalents which fall within the range of the claims are intended to be embraced therein.

What is claimed is:

1. An apparatus for precision cutting of a fiber tow, comprising:

a pair of securing members, the pair of securing members being separated from each other by a predetermined distance and securing a taut length of fiber tow therebetween at two points separated from each other by the predetermined distance;

a movable cutter, the cutter including at least one cutting edge for cutting the taut length of fiber tow; and a pair of flat plates, the taut length of fiber tow being held between the pair of flat plates while the taut length of fiber tow is cut by the cutter, each flat plate of the pair of flat plates having one or more openings therein disposed at predetermined positions relative to positions of the pair of securing members, the openings in a first one of the flat plates of the pair of flat plates and a second one of the flat plates of the pair of flat plates extending transversely relative to a longitudinal direction of the fiber tow, the openings in the first one of the flat plates of the pair of flat plates aligning with corresponding openings in the second one of the flat plates of the pair of flat plates, the openings in each flat plate of the pair of flat plates guiding the cutting edge as it is moved by the cutter to cut the taut length of fiber tow.

2. The apparatus of claim 1, further comprising means for aligning the pair of flat plates in position relative to the securing members.

3. The apparatus of claim 1, further comprising means for selectively raising or lowering one of the first flat plate of the pair of flat plates relative to the second flat plate of the pair of flat plates.

4. The apparatus of claim 1, wherein the cutter includes a razor blade.

5. The apparatus of claim 4, wherein the cutter includes means for reciprocating the razor blade.

6. The apparatus of claim 4, wherein the razor blade is detachably mounted to the cutter.

7. The apparatus of claim 1, wherein the cutter includes two or more cutting edges, the cutting edges being guided by the openings substantially perpendicularly against the taut length of fiber tow at a predetermined distance relative to one another.

8. The apparatus of claim 7, wherein the two or more cutting edges simultaneously cause two shear cuts in the taut length of fiber tow.

9. A method for precision cutting of a fiber tow, comprising the steps of:

securing a length of fiber tow in a taut condition between two points separated from each other by a predetermined distance;

holding the fiber tow in position between a pair of flat plates, each of the flat plates having one or more openings therein extending transversely relative to a longitudinal direction of the fiber tow, the openings on each flat plate being aligned with openings on the other flat plate;

guiding, as the fiber tow is held in position between the pair of flat plates, a means for cutting the fiber tow through the openings in the flat plates and perpendicularly against the fiber tow at a second predetermined distance of the openings in the flat plates relative to the two points to cause a shear cut in the fiber tow.

10. An apparatus for precision cutting of a fiber tow, comprising:

two end block assemblies separated from each other by a predetermined distance, each end block assembly including an end block having an end block channel and an end block wedge receivable in the end block channel;

a pair of guide plates disposed between the two end block assemblies, at least a first one of the pair of guide plates being movable with respect to the two end block assemblies, the pair of guide plates each having one or more slots therein, the one or more slots in the first one of the pair of guide plates corresponding to and aligning with the one or more slots in a second one of the pair of guide plates, the one or more slots being disposed at predetermined distances relative to one another and relative to the two end block assemblies;

a cutter having cutting blades corresponding to the one or more slots in the pair of guide plates and being movable into and out of the one or more slots;

wherein a length of fiber tow is clamped in a taut condition by the two end block assemblies, the taut length fiber tow extends between and is held in position by the pair of guide plates, and the one or more cutting blades are moved into and guided by the one or more slots to cut the taut length of fiber tow into lengths corresponding to the predetermined distances between the one or more slots and the two end block assemblies.

* * * * *